United States Patent [19]

Chielens

[11] 3,934,641

[45] Jan. 27, 1976

[54] COOLING ARRANGEMENT FOR CONTINUOUSLY CAST METAL OBJECTS

[75] Inventor: Alain Chielens, Marcq-en-Baroeul, France

[73] Assignee: Fives-Cail Babcock, Paris, France

[22] Filed: Jan. 10, 1975

[21] Appl. No.: 539,939

[30] Foreign Application Priority Data

Mar. 20, 1974 France ..... 74.09449

[52] U.S. Cl. ..... 164/283 S; 239/428; 239/433; 239/550; 239/559

[51] Int. Cl.[2] ..... B22D 11/124

[58] Field of Search ..... 164/283 R, 283 S, 283 MS; 239/418, 420, 426, 423, 425, 427, 544, 559, 428, 433, 434, 550, 556, 557, 566

[56] References Cited

UNITED STATES PATENTS

| | | | |
|---|---|---|---|
| 388,930 | 9/1888 | Thayer | 239/566 X |
| 2,551,538 | 5/1951 | Hensel | 239/566 X |
| 2,677,626 | 5/1954 | Bodle et al. | 239/544 X |
| 2,791,812 | 5/1957 | Dangelzer et al. | 164/283 |
| 2,871,529 | 2/1959 | Kilpatrick | 164/283 S |
| 3,176,355 | 4/1965 | Ljungstromer | 164/283 S |
| 3,335,956 | 8/1967 | James | 239/418 X |
| 3,468,362 | 9/1969 | Burkhardt et al. | 164/283 S X |
| 3,480,211 | 11/1969 | Vertesi et al. | 239/557 X |
| 3,771,584 | 11/1973 | Wojcik | 164/283.5 S X |

FOREIGN PATENTS OR APPLICATIONS

| | | | |
|---|---|---|---|
| 7,008 | 5/1915 | United Kingdom | 239/544 |

*Primary Examiner*—Ronald J. Shore
*Attorney, Agent, or Firm*—Kurt Kelman

[57] ABSTRACT

A mixture of water and air atomizing the water is directed toward the externally solidified metal strand discharged from the mold of a continuous casting machine from an elongated header in which air and water are separately fed at elevated pressures to longitudinal rows of apertures in the front wall of the header, the rows being symmetrically arranged relative to a longitudinal plane to form a mist which is propelled from the front wall toward an opposite face of the moving metal object.

12 Claims, 11 Drawing Figures

COOLING ARRANGEMENT FOR CONTINUOUSLY CAST METAL OBJECTS

This invention relates to the continuous casting of metals, and particularly to a cooling arrangement for the metal object discharged from the mold of a continuous casting apparatus.

The mold of such apparatus is usually water-cooled to form a solid skin on the metal introduced into the top of the mold in the liquid state, and a tube of solid metal filled with melt is discharged from the bottom of the mold and needs to be guided while being further cooled for complete solidification. It is essential for proper structure of the solidified metal ultimately obtained that such further or secondary cooling be carried out in a precisely defined manner to avoid cracks and other defects.

It has been common practice heretofore to discharge water droplets against the moving metal object in the secondary cooling zone from atomizing nozzles distributed about the strand of metal among the guiding rolls and similar supporting structure. It is difficult or even impossible to achieve uniform cooling over the entire surface of the cast metal body in this manner, particularly in the case of relatively wide steel slabs intended for rolling.

If it is desired to modify the cooling conditions, for example, when switching to the casting of steel objects of a different composition, each of the nozzles of the known cooling arrangements must be adjusted or replaced individually, a time-consuming job during which the casting machine stands still.

It is an object of this invention to provide a secondary cooling arrangement for continuous casting apparatus which permits a uniform cooling effect to be achieved over a large surface of the cast object regardless of its shape and size. Another object is the provision of a cooling arrangement whose cooling effect can be controlled by external devices without structurally modifying the cooling devices proper.

Basically, the invention provides a relatively small number of headers elongated substantially parallel to the surface of the object to be cooled which moves in a path defined by guiding, supporting, and driving devices conventional in themselves.

In one of its more specific aspects, the invention provides, in addition to such devices defining the path of movement of the metal object, a tubular header assembly elongated in a direction substantially parallel to an outer face of the moving object and defining a front wall directed toward that outer face. The front wall is formed with two rows of first apertures symmetrical to a plane longitudinal relative to the header device and substantially perpendicular to the outer face of the moving object. Each first aperture has an axis intersecting the axis of an aperture of the other row in the plane of symmetry. The front wall is further formed with at least one row of second apertures arranged between the rows of first apertures.

The header assembly is partitioned to bound a plurality of conduits which respectively communicate with the rows of first and second apertures. A source of air under pressure higher than atmospheric pressure communicates with one of the conduits, and a source of water under similar pressure communicates with another conduit.

Other objects, additional features, and many of the attendant advantages of this invention will readily be appreciated as the same becomes better understood by reference to the following detailed description of preferred embodiments when considered in connection with the appended drawing in which.

Figure 1:
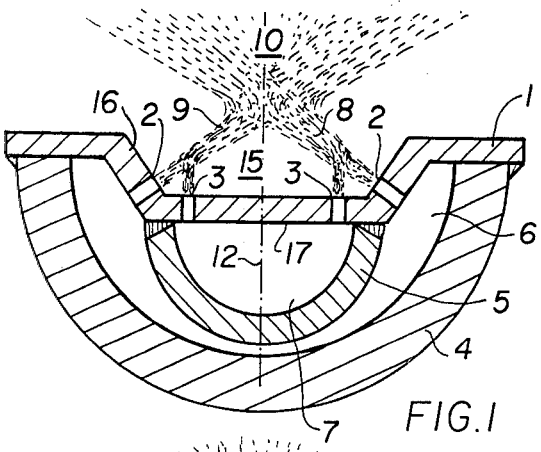
FIG. 1 shows a header of the invention in cross section on the line I — I in FIG. 2.
Figure 2:
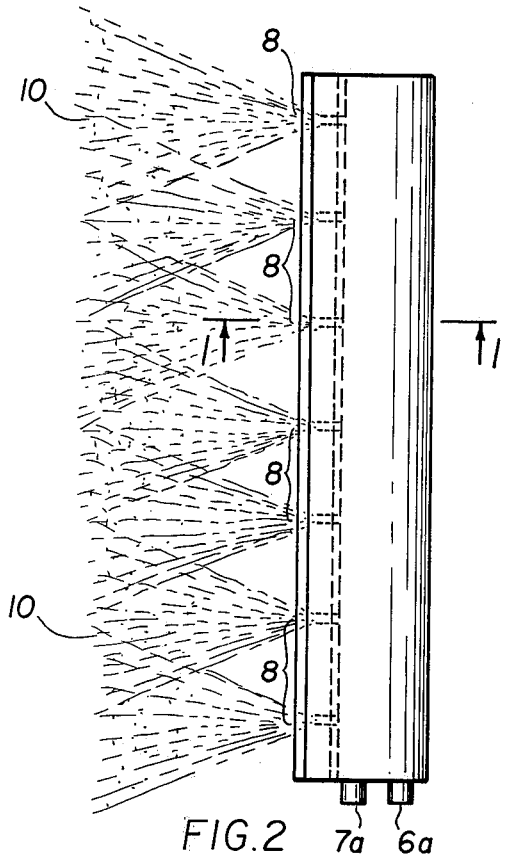
FIG. 2 is a side-elevational view of the header of FIG. 1 on a smaller scale.

Referring now to the drawing in detail, and initially to FIGS. 1 and 2, there is shown a header for use in a cooling arrangement of the invention which has three longitudinal walls 1, 4, 5 connected by transverse end walls, not specifically shown, at their longitudinal ends. The front wall 1 is made of an initially flat piece of sheet metal whose center portion was offset between shaping rolls to provide an outwardly open, longitudianal groove 15. The two side walls 16 of the groove slope obliquely to the flat bottom wall 17 and are each formed with a row of uniformly spaced first apertures 2 whose axes are perpendicular to the respective side walls. The walls 1, 4, 5 and the rows of apertures 2 are symmetrical relative to a longitudinal plane of symmetry 12 which is perpendicular to the bottom wall 17.

The axis of each aperture 2 thus intersects the axis of an aperture 2 in the other row in the plane 12. The bottom wall 17 is formed with two rows of second apertures 3, the longitudinal spacing of the apertures being equal to that of the apertures 2 between which the apertures 3 are arranged. Each pair of apertures 3 is located in a common transverse plane with two apertures 2 so that the axes of the apertures 3, which are perpendicular to the bottom wall 17 intersect the axes of respective apertures 2. Each aperture 2, 3 may typically have a diameter of 0.5 to 5 millimeters.

The rear wall 4 of the illustrated header is semi-cylindrical in shape, and its longitudinal edges are welded to the rear face of the front wall 1 adjacent the longitudinal edges of the front wall. The cavity of the header bounded by the walls 1, 4 and the afore-mentioned end walls is divided by the partition wall 5 into two conduits 6, 7. The partition wall 5 is also semi-cylindrical, and its longitudinal edges are welded to the bottom wall 17 adjacent the junctions of the latter with the side walls 16.

The first apertures 2 thus communicate with the conduit 6 bounded by the rear wall 4 and the partition wall 5, and the second apertures 3 communicate with the other conduit 7 between the bottom wall 17 and the partition wall 5. Two fluids may be fed separately to the two conduits through connectors 6*a*, 7*a* in one of the end walls, the connectors constituting respective sources of such fluids.

The header shown in FIGS. 1 and 2 is preferably supplied with compressed air through the connector 6*a*, the pressure of the air being sufficient for discharge of the air from the apertures 2 at a velocity of at least 75 meters per second, higher pressures being practical up to an air discharge velocity as high as the velocity of sound in the air. Water is supplied by the connector 7a and other elements of a conventional supply system for discharge from the second apertures 3 into the air streams from the apertures 2 so that two jets 8, 9 of atomized water are propelled toward each other and meet in the plane 12 to produce a mist 10 of fine droplets travelling away from the front wall 1 in approximately conical patterns which merge at a small distance from the front wall, as is best seen in FIG. 2 for impingement on a metal surface to be cooled.

Figure 3:
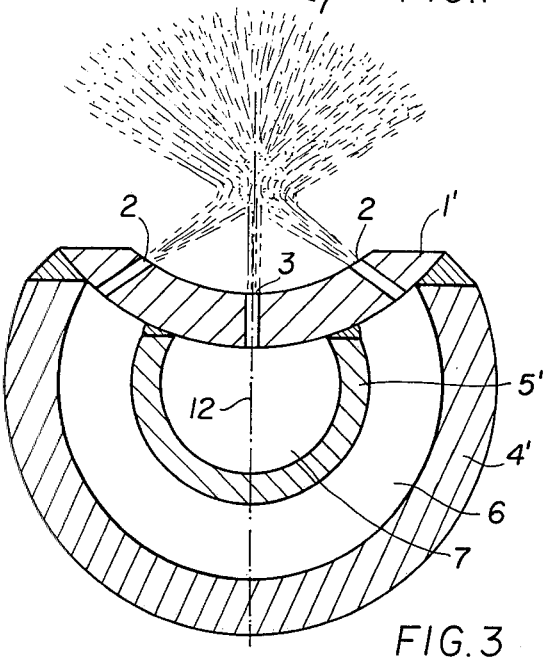
FIGS. 3 and 4 show another header of the invention in views respectively corresponding to those of FIGS. 1 and 2.
Figure 4:
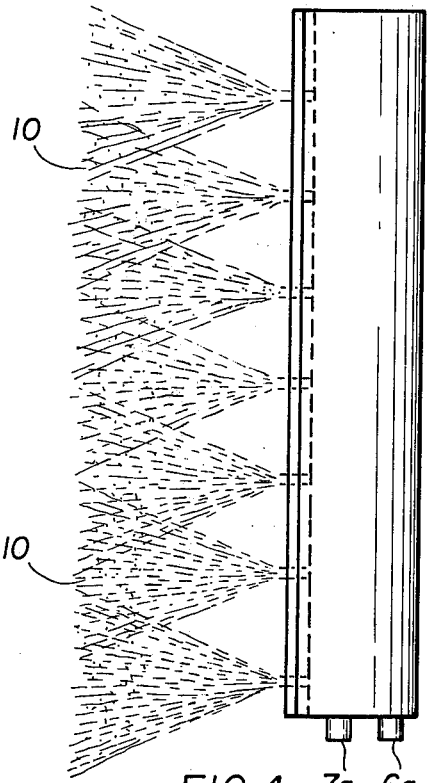

An analogous pattern is produced by the header shown in FIGS. 3 and 4 whose longitudinal walls 1', 4', 5' are segments of hollow cylinders. The outer face of the front wall 1' is concave and has two rows of first apertures 2 symmetrically spaced from the common plane of symmetry 12 of the walls 1', 4', 5' and a single central row of apertures 3. The rear wall 4' extends in a circular arc of about 120° between the longitudinal edges of the front wall to which it is welded, and the partition wall 5' is coaxial with the rear wall 4'. Air and water are discharged respectively from the apertures 2, 3 in the manner described with reference to the apparatus of FIGS. 1 and 2, the water stream from each aperture 3 extending along the axis of the aperture 3 in the plane 12 and being intersected simultaneously by two air streams from apertures 2 to form a mist pattern similar to that described above.

Figure 5:
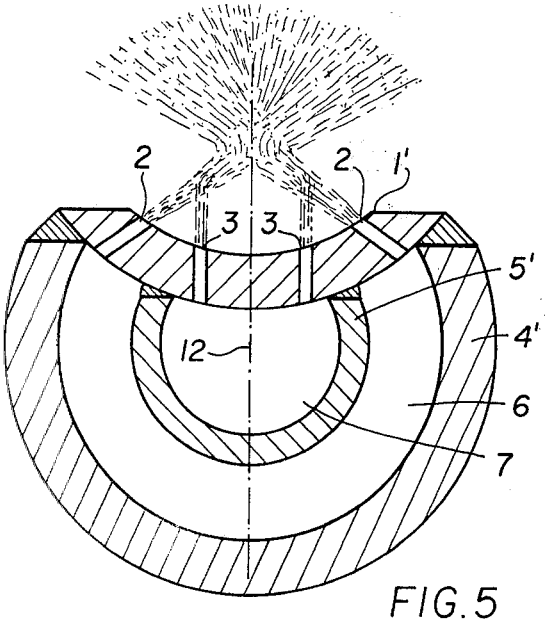
FIGS. 5 and 6 illustrate additional headers of the invention in views corresponding to FIGS. 1 and 3.
Figure 6:
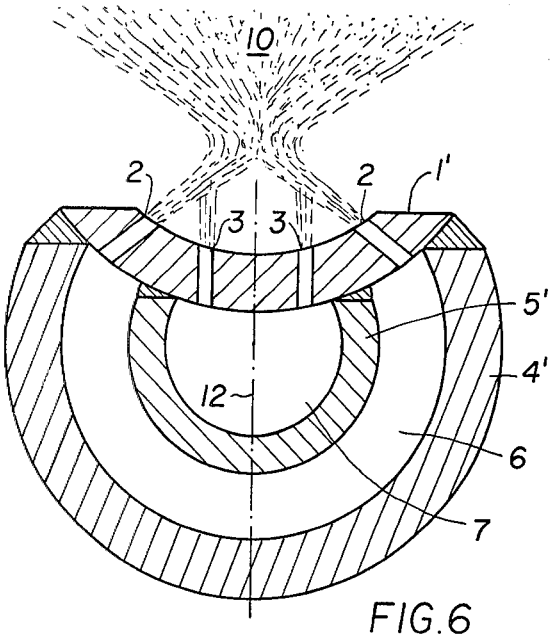

The three walls 1', 4', 5' of the headers shown in FIGS. 5 and 6 do not differ significantly from the corresponding elements shown in FIG. 3, but the front walls 1' are provided with two rows of second apertures 3 symmetrically arranged relative to the planes 12. The axes of the apertures 3 in the device of FIG. 5 are parallel to the plane 12, whereas the axes of the apertures 3 shown in FIG. 6 converge to meet in the plane 12. The resulting mist patterns are somewhat different, but all headers produce a uniform mist of rapidly moving water droplets uniformly distributed over the entire length of each header and spreading laterally well beyond the width of the header.

Similar, though sometimes less advantageous results are achieved, when the connector 6a serves as a source of water under pressure to be discharged from the apertures 2 and atomized by air supplied by the connector 7a and released from the apertures 3.

Figure 7:
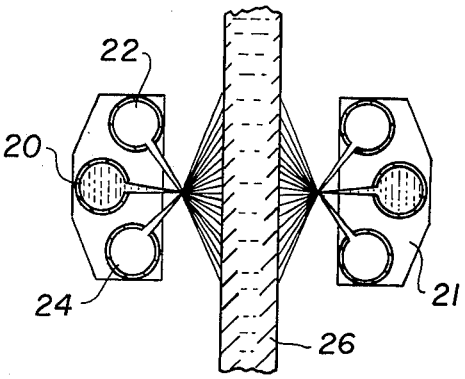
FIG. 7 illustrates a cooling arrangement of the invention including yet another type of header in fragmentary, sectional elevation.

Two header assemblies functionally analogous to the header shown in FIG. 3 are illustrated in FIG. 7. Each header assembly consists of three pipes 20, 22, 24 mounted between two end plates 21 of which only one is seen in FIG. 7, the non-illustrated end plate being provided with connectors for supplying water to the pipe 20 which is flanked by the two other pipes 22, 24 supplied with compressed air. Longitudinal rows of transversely aligned apertures project converging streams of water and air toward a row of points in the plane of symmetry of each header, a mist of fine droplets being spread over the full width of the wide faces of a partly solidified, continuous slab 26 released from a non-illustrated mold.

The front wall in the headers of FIG. 7 is constituted by parts of the circumferences of the pipes 20, 22, 24 while the remaining parts of the circumferences constitute partitions which bound conduits for the operating fluids. The mode of operation is the same as described above with reference to FIG. 3.

The headers shown in FIGS. 1 to 7 generally are arranged between pairs of support members for the moving slab and are elongated horizontally over the full width of the slab and beyond to reach the narrow slab faces, but separate headers may be mounted in a vertical position along such narrow faces if desired.

Figure 8:
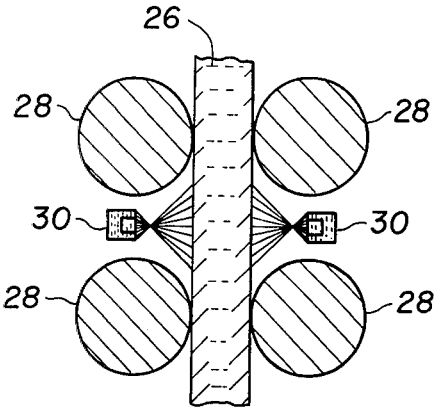
FIGS. 8 to 11 show additional cooling arrangements including headers which may be of any of the types shown in FIGS. 1 to 7 in respective elevational views and partly in section.

FIG. 8 shows a cooling arrangement for a slab 26 in which two headers 30, each identical with any one of the afore-mentioned headers, are arranged between respective pairs of guide rolls 28 opposite the two wide outer faces of the slab. While not expressly shown in FIG. 8, it is entirely feasible to cover the entire area of a slab surface exposed between two consecutive rollers 28 with the mist of water droplets produced by one header of the invention in a manner obvious from FIGS. 9 to 11.

Figure 9:
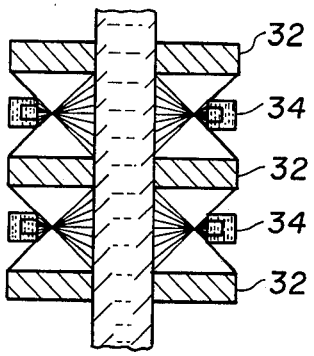
Figure 10:
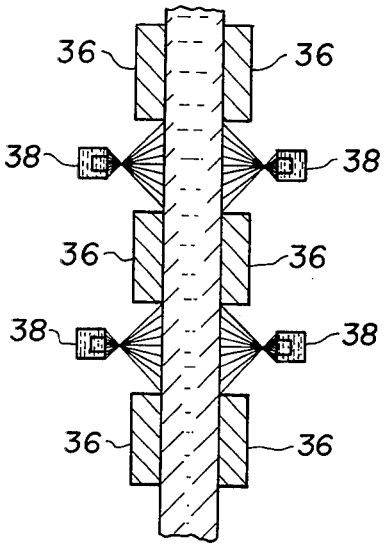
Figure 11:
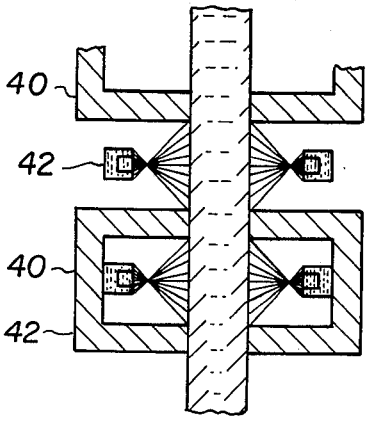

The supporting structure for the slab shown in FIG. 9 has the approximate shape of two gratings whose bars 32 bound openings. Headers 34 according to the invention are mounted in the openings. Pads or shoes 36, which may be water-cooled internally in a manner not shown, but conventional, slidably engage the moving slab in the arrangement shown in FIG. 10, and headers 38 are mounted between the pads which are spaced along the path of slab movement. The support elements 40 illustrated in FIG. 11 are channels open toward the traveling metal object which is guided by the flange edges of the channels 40. Headers 42 are arranged not only between adjacent channels, but also in the open cavities of the channels.

It is a common feature of the several headers described above, that they provide uniform cooling over the entire area of the moving metal object to which they are assigned. If casting conditions change, the intensity of cooling provided by each header is readily adjusted in a simple manner by means of valves in the air and water supply systems represented by the connectors 6a, 7a which can be arranged for convenient access and may be adjusted without interrupting the casting operation, if so desired. No structural changes in the headers themselves and no replacement of the headers are required.

Obvious modifications may be made in the cooling arrangements described above without losing the advantages of this invention. Thus, the pattern of apertures may be modified to produce convergence of air and water streams at the acute angles necessary for dispersion of the water. Dimensions of the apparatus will be selected by those skilled in the art to suit specific operating conditions. Thus, the transverse planes in which two first apertures 2 and at least one second aperture 3 is located may be spaced apart 5 mm to 100 mm, and the distance between the front wall of a header and the surface to be cooled may vary generally between 5 mm and 3 meters. The ratio of water and air is equally capable of adjustment over a wide range readily determined by trial and error.

Other changes in the examples of the invention herein chosen for the purpose of the disclosure will readily suggest themselves to those skilled in the art. If will be understood therefore that, within the scope of the appended claims, this invention may be practiced otherwise than is specifically disclosed.

What is claimed is:

1. A cooling arrangement for a continuously cast metal object comprising:

a. means defining a path of movement for said object, the object having an outer face extending in the direction of said path; and b. tubular header means for projecting a cooling fluid toward said face, said header means being elongated in a direction substantially parallel to said face and defining a front wall directed toward said face, 1. said front wall being formed with two rows of first apertures symmetrical to a plane longitudinal relative to said header means and substantially perpendicular to said face, 2. each first aperture having an axis intersecting the axis of an aperture of the other row in said plane, 3. said front wall being further formed with at least one row of second apertures arranged between the rows of first apertures;

c. partition means of said header means bounding a plurality of conduits respectively communicating with said rows of first apertures and said at least one row of second apertures; and d. a source of air under pressure higher than atmospheric pressure communicating with one of said conduits; and e. a source of water under pressure higher than atmospheric pressure communicating with another one of said conduits.

2. An arrangement as set forth in claim 1, wherein said second apertures have respective axes located in said plane.

3. An arrangement as set forth in claim 1, wherein said second apertures constitute two rows symmetrical relative to said plane.

4. An arrangement as set forth in claim 1, wherein said front wall has a concavely arcuate face directed toward said path and formed with said first and second apertures.

5. An arrangement as set forth in claim 1, wherein said header means includes a rear wall, said front wall and rear wall constituting the outer walls of said header means and bounding a cavity therein, said partition means including a partition member elongated in the direction of said path and having two longitudinal edges sealed to said front wall, said partition member dividing said cavity into a first one of said conduits communicating with each of said first apertures and a second one of said conduits communicating with each of said second apertures.

6. An arrangement as set forth in claim 5, wherein said rear wall and said partition member are of circularly arcuate cross section.

7. An arrangement as set forth in claim 5, wherein said front wall is formed with a longitudinal groove having a bottom wall and two side walls, said side walls being formed with said two rows of first apertures respectively, and said bottom wall being formed with said at least one row of second apertures.

8. An arrangement as set forth in claim 1, wherein said header means includes a plurality of tubular members, respective portions of said members jointly defining said front wall and being formed with said rows of apertures respectively, other respective portions of said members constituting said partition means.

9. A cooling arrangement for a continuously cast metal object comprising:

a. support means defining a path of movement for said object and supporting said object when moving in said path, said support means including a plurality of support members spacedly arranged along said path, and said object having an outer face extending in the direction of said path; and b. a plurality of header means for projecting cooling fluid toward said path, each of said header means being elongated in a direction substantially parallel to said face and defining a front wall directed toward said face, 1. said front wall being formed with two rows of first apertures symmetrical to a plane longitudinal relative to said header means and substantially perpendicular to said face, 2. each first aperture having an axis intersecting the axis of an aperture of the other row in said plane, 3. said front wall being further formed with at least one row of second apertures arranged between the rows of first apertures;

c. partition means of said header means bounding a plurality of conduits respectively communicating with said rows of first apertures and said at least one row of second apertures; and d. a source of air under pressure higher than atmospheric pressure communicating with one of said conduits; and e. a source of water under pressure higher than atmospheric pressure communicating with another one of said conduits.

10. An arrangement as set forth in claim 9, wherein one of said support members is formed with a cavity open toward said path, one of said header means being received in said cavity.

11. An arrangement as set forth in claim 9, wherein said support members constitute a grating and define openings therebetween, said header means being aligned with respective openings in said grating in a direction toward said path.

12. An arrangement as set forth in claim 1, wherein the pressure of said air is sufficient to discharge said air from the associated apertures in said front wall at a velocity of at least 75 meters per second, but not greater than the velocity of sound in said air.

* * * * *